United States Patent [19]

Esplin

[11] Patent Number: 4,809,611

[45] Date of Patent: Mar. 7, 1989

[54] OPTICAL SYSTEM FOR CONICAL BEAM TARGET DETECTION

[75] Inventor: Roy W. Esplin, Mesa, Ariz.

[73] Assignee: Motorola, Inc., Schaumburg, Ill.

[21] Appl. No.: 45,964

[22] Filed: May 4, 1987

[51] Int. Cl.[4] ..... F42C 13/02

[52] U.S. Cl. ..... 102/213

[58] Field of Search ..... 102/213; 244/3.16

[56] References Cited

U.S. PATENT DOCUMENTS

| | | | |
|---|---|---|---|
| 2,892,093 | 6/1959 | Henderson | 102/213 |
| 3,242,339 | 3/1966 | Lee | 102/213 |
| 3,621,784 | 11/1971 | Mundie et al. | 102/213 |
| 3,786,757 | 1/1974 | Goldstein et al. | 102/213 |
| 4,195,574 | 4/1980 | MacNeille | 102/213 |
| 4,385,833 | 5/1983 | Gardner | 102/213 |
| 4,563,064 | 1/1986 | Gards | 350/620 |

OTHER PUBLICATIONS

Miyamoto, Kenro; "Fish Eye Lens"; *Journal of the Optical Society of America;* vol. 54, 8/1964; pp. 1060–1061.

DeVany, Arthur S.; *Master Optical Techniques;* pp. 305-322; 1981.

*Primary Examiner*—Charles T. Jordan

*Attorney, Agent, or Firm*—Maurice J. Jones

[57] ABSTRACT

A passive, infrared, conical beam target sensor having multiple beams which may exhibit a wide variety of half conic angles is disclosed. The sensor may be utilized with a missile by positioning a plurality of optical assemblies adjacent to the skin of the missile and near a corresponding plurality of small windows in the skin of the missile. Each optical assembly includes a detector for each conical beam and a wide-angle lens oriented so that a lens axis parallels the axis of the missile. A preferred lens has a flat entrance aperture surface opposing a spherical surface. Unnecessary material is removed from the lens so that the lens axis may reside as close to the missile skin as possible. Each detector includes a plurality of photoelectric elements arranged to populate at least a portion of an annulus.

18 Claims, 3 Drawing Sheets

OPTICAL SYSTEM FOR CONICAL BEAM TARGET DETECTION

BACKGROUND OF THE INVENTION

This invention relates generally to optical systems which sense the presence of a target. Specifically, the present invention relates to optical systems which utilize a conical beam or field of view. More specifically, the present invention relates to a target detector which is useful to a missile that must detect the presence of a target.

Such missiles operate in an environment which causes the missiles to experience severe shocks and vibrations. Accordingly, optical target detection systems used in such missile must also withstand the severe shock and vibration environment. Additionally, such missiles are typically not reusable and are produced in large quantities. Thus, optical target detection systems used in these missiles should be inexpensive.

Optical systems previously used with these missiles suffer many drawbacks. For example, some optical systems require a lens which completely surrounds the missile. Such a design is not structurally sound in a severe shock and vibration environment because the strength of the missile depends upon the relatively low strength of the lens. Furthermore, some optical systems tend to produce a focal point at the center of the missile. These systems tend to require too much volume within the interior of the missile. Additionally, such systems tend to represent non-imaging systems which smear the optical image so that no point-to-point correspondence exists between the target being sensed and the target's image. As a consequence, such optical systems do not provide azimuth information. Still further, some optical systems require a relatively large detector which is expensive and which generates a noisy output signal when compared to smaller detectors.

Other prior art optical systems utilize complicated multiple lens or multiple mirror arrangements. Such complicated arrangements represent unreliable systems in the severe shock and vibration environment and additionally tend to operate only over a small half conic angle range. As a consequence, such systems tend to be relatively expensive and to allow only a single conical beam.

Other prior art optical detection systems utilize lenses or mirrors in which the lens or mirror axis is not parallel with the missile axis. An unsymmetrical output response with azimuth results. In other words, such systems do not provide a true conical response because the output signals may change several DB depending upon the angle of view.

As another example, some prior systems do not allow electronic steering of the optical beam. Thus, either the optical target detection system provides a limited amount of information or a mechanical steering structure must be employed. Mechanical steering structures are relatively expensive and unreliable in the severe shock and vibration environment that a missile experiences.

SUMMARY OF THE INVENTION

Accordingly, it is an object of the present invention to provide an improved conical beam target sensor in which an output signal responds uniformly with azimuth.

Another object of the present invention concerns providing an improved conical beam target sensor which uses only a single element lens so that the resulting sensor may be simple, reliable, and relatively inexpensive.

Yet another object of the present invention concerns providing an improved conical beam target sensor which looks out a relatively small side window in a missile.

Still another object of the present invention concerns providing an improved conical beam target sensor that permits multiple optical beams.

Yet another object of the present invention concerns providing an improved conical beam target sensor that provides azimuth information.

The above and other objects and advantages of the present invention are carried out in one form by a conical beam target sensor in which a wide angle lens is positioned so that the lens axis is noncoincident with an axis of the missile and is parallel to the axis of the missile. Additionally, the conical beam target sensor includes a detector array which is formed to resemble at least a portion of an annulus wherein the center of the annulus is coincident with the lens axis.

BRIEF DESCRIPTION OF THE DRAWINGS

A more complete understanding of the present invention may be derived by reference to the detailed description and claims when considered in connection with the accompanying drawings, wherein like reference numbers indicate similar features, and wherein:

DETAILED DESCRIPTION OF THE PREFERRED EMBODIMENT

Figure 1:
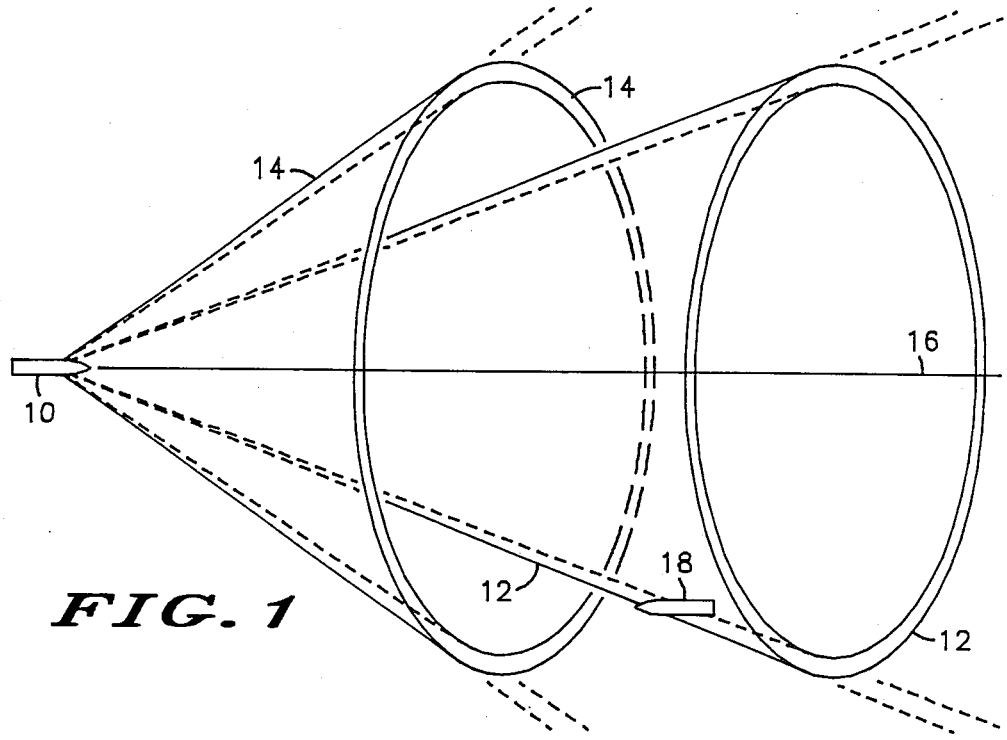
FIG. 1 shows a relationship between optical conical beams and a missile.

FIG. 1 shows a missile 10 from which an inner conical beam 12 and an outer conical beam 14 project. An axis 16 represents an axis of missile 10 and an aggregate axis around which conical beams 12 and 14 are symmetrical.

In the preferred embodiment of the present invention, missile 10 utilizes passive infrared sensing to detect whether an object, such as a target 18, is within conical beams 12 or 14. Thus, conical beams 12 and 14 represent imaginary beams which define a field of view within which missile 10 senses the presence of objects, such as target 18.

Each of conical beams 12 and 14 resembles a cone, or a funnel. Specifically, each of conical beams 12 and 14 may be defined as the volume of space that exists between missile 10, representing the point of the cone, an inner and an outer half conic angle, which together define the thickness of the cone's walls, and a predetermined distance forward of missile 10, which is defined by the sensitivity of an optical system utilized in missile 10. This predetermined distance forward of missile 10 represents the distance between the point and the base of the cone. Accordingly, conical beams 12 and 14 represent walls of hollow cones which project forward of missile 10 in space. Conical beams 12 and 14 do not include the interior volume of the cones.

Since the preferred embodiment of the present invention utilizes passive infrared sensing, the optical system within missile 10 detects infrared radiation emitted from target 18 only when target 18 exists within one of conical beams 12 and 14. In other words, object 18 may be photoelectrically viewed by missile 10 when object 18 intersects one of the walls of conical beams 12 and 14. The use of two conical beams rather than a single conical beam permits missile 10 to receive a greater amount of information than may be received through the use of a single conical beam. For example, missile 10 may conduct electronic beam steering applications by switching between conical beams 12 and 14.

Conical beam 12 permits missile 10 to look farther forward of missile 10 than is permitted by conical beam 14. On the other hand, conical beam 14 permits missile 10 to sense objects within a broader area than conical beam 12 at a given distance forward of missile 10. Additionally, the use of two conical beams permits missile 10 to sense relative velocity between target 18 and missile 10 by measuring the interval of time that transpires between the intersection of conical beam 12 and the intersection of conical beam 14 by target 18 or to measure the size of target 18.

Figure 2:
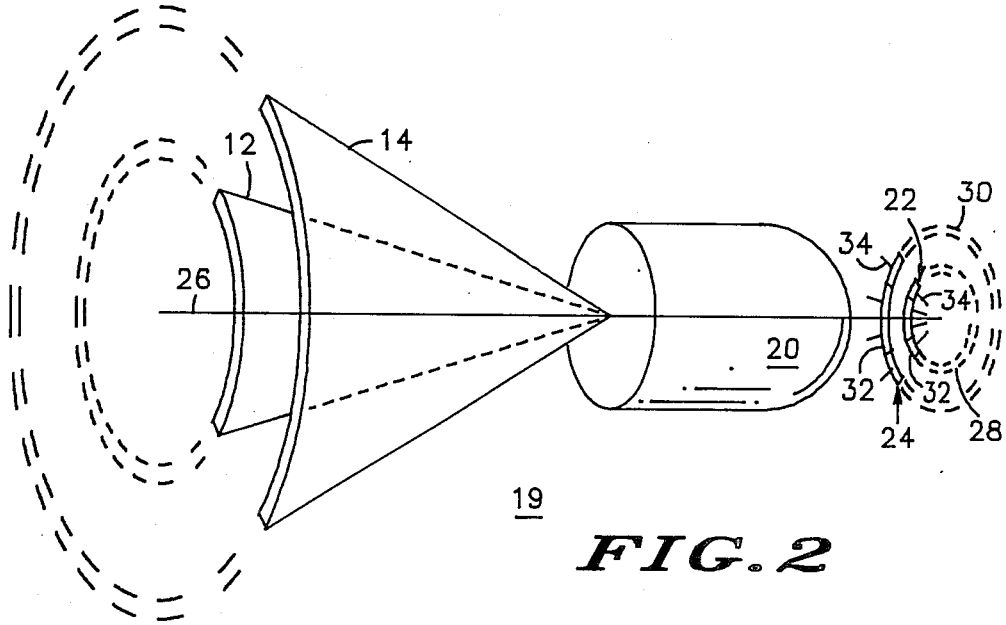
FIG. 2 shows cooperation between a lens, a detector, and optical beams.

FIG. 2 shows the basic operation of an optical assembly 19 utilized by the present invention. Optical assembly 19 includes a wide-angle, low f-number, short focal length lens 20 positioned near an inner detector 22 and an outer detector 24. For purposes of the present invention, such wide-angle lenses may be defined as a lens which has a field of view greater than 25°. Thus, those lenses which are recognized by persons skilled in the art to represent a wide-angle lens will suffice for lens 20. Lens 20 has a lens axis 26 associated therewith. Lens axis 26 may be positioned within missile 10 (see FIG. 1) so that lens axis 26 is noncoincident with, but parallel to axis 16 of missile 10. Resultingly, lens axis 26 is parallel to the aggregate axis of conical beams 12 and 14.

Detector 22 senses light emanating from within conical beam 12, and detector 24 senses light emanating from within conical beam 14. Each of detectors 22 and 24 represent an annulus or at least a portion of an annulus. An annulus represents a ring-like geometrical shape. In other words, an annulus represents the area which exists between two concentric circles. In the present invention, annuluses 28 and 30 each reside perpendicular to axis 26, and the center of annuluses 28 and 30 each reside on axis 26. Annulus 28 exhibits a first predetermined radius which is smaller than a second predetermined radius exhibited by annulus 30. It is the first and second predetermined radiuses of annuluses 28 and 30 which define the half conic angles associated with conical beams 12 and 14. Accordingly, a larger radius exhibited by detector 24 using annulus 30 produces a larger half conic angle for conical beam 14, and a smaller radius for detector 24 using annulus 30 produces a smaller half conic angle for conical beam 14. Additionally, the width of detectors 22 and 24 defines the wall thickness for conical beams 12 and 14. For example, if the difference between radiuses of two concentric circles which define inner annulus 28 increases, then the wall thickness of inner conical beam 12 increases.

As shown in FIG. 2, detector 22 may populate only a portion of inner annulus 28, and outer detector 24 may populate only a portion of outer annulus 30. When only a portion of annuluses 28 and 30 are populated by detectors 22 and 24, respectively, conical beams 12 and 14 resultingly represent only a corresponding portion of full cones. In the preferred embodiment, an optical assembly 19 produces conical beams 12 and 14 which extend for only 90° in azimuth around axis 26. These 90° conical beams result from detector 22 populating only 90° of inner annulus 28 and detector 24 populating only 90° of outer annulus 30. FIG. 2 shows the 90° portions of inner conical beam 12 and outer conical beam 14 in solid lines while the remainder of conical beams 12 and 14 are shown in phantom. Thus, if target 18 (see FIG. 1) intersects conical beams 12 or 14 within the solid portions shown in FIG. 2, then optical assembly 19 senses the presence of target 18. However, if target 18 intersects conical beams 12 or 14 in the portion of conical beams 12 and 14 shown in phantom in FIG. 2, then optical assembly 19 will not sense the presence of target 18.

Each of detectors 22 and 24 are made from a plurality of individual and independent photoelectric elements 32 arranged in an array to form at least a portion of annuluses 28 and 30. Any one of the many different technologies utilized for photoelectric elements known to those skilled in the art may be employed by the present invention. Such photoelectric elements utilize any of a variety of electrical effects which occur due to the interaction of light or other radiation with the substance from which photoelectric elements 32 are constructed.

Additionally, each of photoelectric elements 32 includes an electrical conductor 34 coupled thereto. Accordingly, when optical assembly 19 senses the presence of target of 18 (see FIG. 1) within conical beams 12 or 14, an electrical signal is provided on electrical conductors 34 to other electronic circuits (not shown) which process this information. This plurality of photoelectric elements 32 and electrical conductors 34 permit electrical assembly 19 to provide azimuth information to missile 10. The present invention represents an imaging optical system in which a point-to-point correspondence exists between an object which intersects conical beams 12 and 14 and a corresponding image formed on detectors 22 and 24, respectively. Thus, the position of a particular one of photoelectric elements 32 which provides an electrical signal indicating the presence of target 18 corresponds to the azimuth of target 18 relative to axis 26.

Figure 3A:
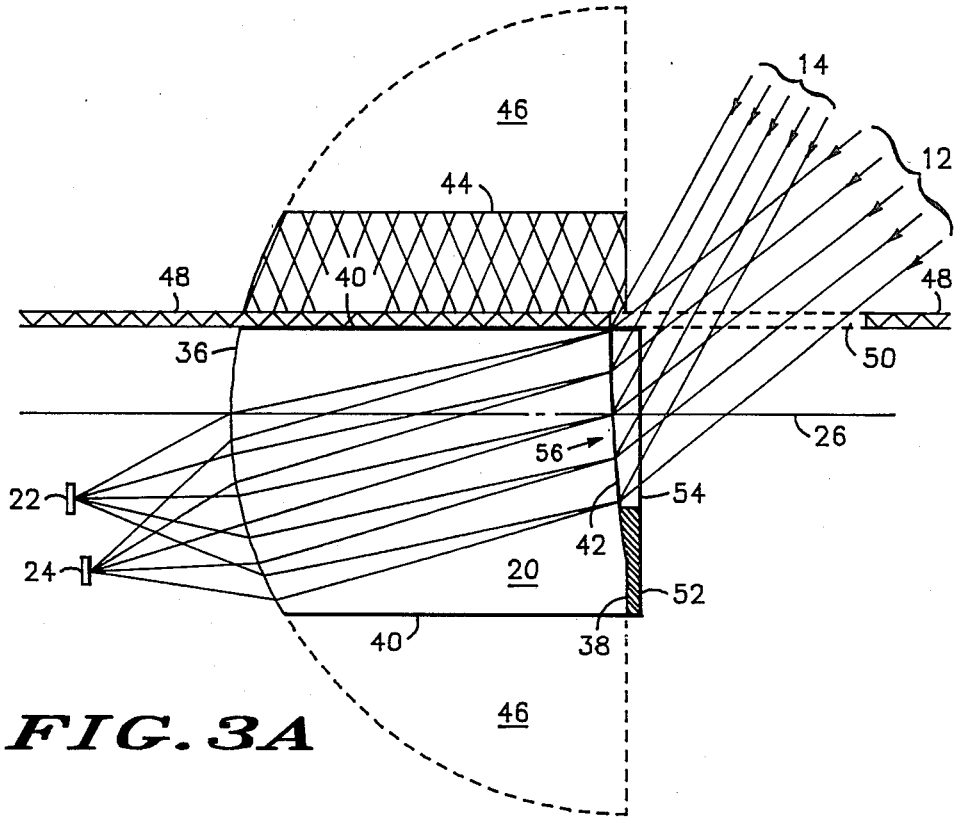
FIG. 3A shows a ray-trace relative to a cross-sectional view of the present invention.
Figure 3B:
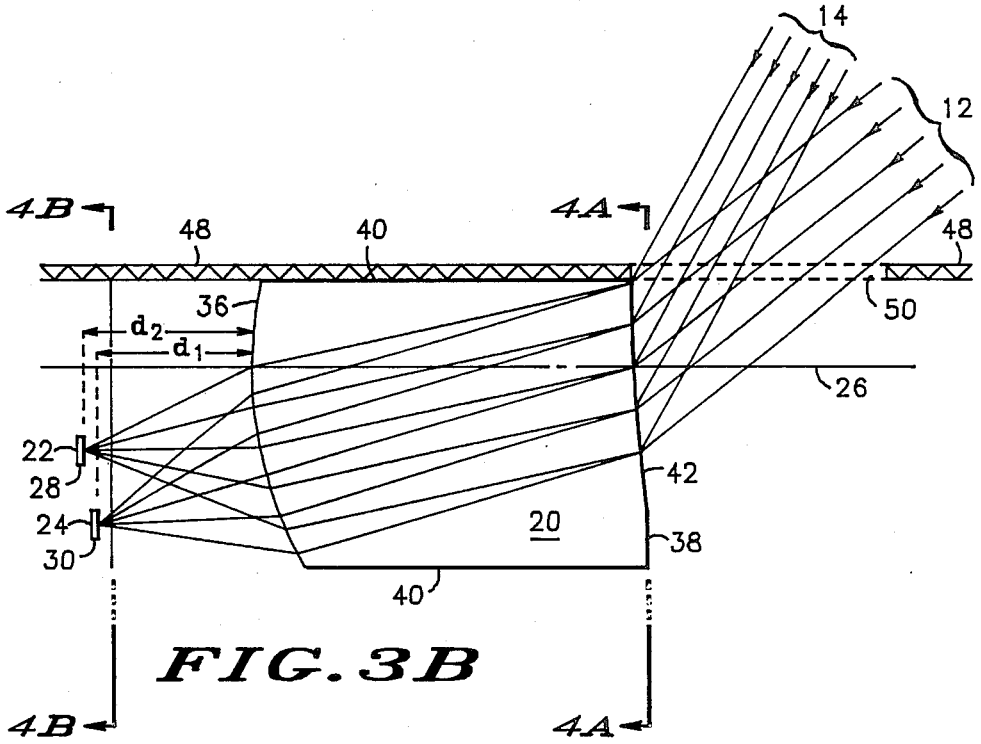
FIG. 3B shows a ray-trace relative to a cross-sectional view of the present invention.

FIGS. 3A and 3B each show a ray-tracing of optical assembly 19 relative to a cross-sectional view of optical assembly 19. FIG. 3A shows portions of wide-angle lens 20 (in phantom) which are not included in lens 20 but help define the shape of lens 20. FIG. 3B shows lens 20 as utilized in the preferred embodiment of the present invention. Referring simultaneously to FIGS. 3A and 3B, rays which represent outer conical beam 14 approach a skin 48 of missile 10 (see FIG. 1) at a greater angle than rays which correspond to inner conical beam 12. Skin 48 surrounds the periphery of missile 10 and represents the boundary between the interior and the exterior of missile 10.

A window 50, which is transparent to infrared radiation, resides in skin 48. Window 50 faces substantially perpendicular to missile axis 16 (see FIG. 1). Since the preferred embodiment contemplates sensing infrared radiation, window 50 need not be transparent to visible light. Window 50 is as small as possible so that skin 48 and missile 10 (see FIG. 1) will exhibit as great a strength as possible and so that missile 10 will withstand the shock and vibration environment within which missile 10 operates. Window 50 is intended to have only an insignificant effect on the light being transmitted therethrough. In other words, light intensity attenuation, and the angles at which conical beams 12 and 14 approach skin 48 change only an insignificant amount after passing through window 50. Lens 20 resides within missile 10 near window 50 and adjacent to skin 48.

Lens 20 resides near window 50 so that conical beams 12 and 14 passing through window 50 encounter a flat surface 38 of lens 20 after passing through a filter 54. Filter 54 represents any of the many conventional filters known to those skilled in the art. Filter 54 filters lights approaching at the angles associated with conical beams 12 and 14. Additionally, an opaque member 52 resides on flat surface 38 of lens 20 so that stray light cannot enter lens 20 in the vicinity of opaque member 52. Resultingly, a circular entrance aperture 56, or aperture stop, resides on flat surface 38 of lens 20 centered on axis 26 of lens 20. After light enters lens 20 at the entrance aperture, it is refracted and propagates through lens 20 until it emerges from a spherical surface 36 of lens 20. After light from conical beams 12 and 14 emerge from spherical surface 36, it focuses at a predetermined focal length from lens 20.

Detectors 22 and 24 reside at this predetermined focal length from lens 20. Thus, spherical surface 36 faces detectors 22 and 24. Referring specifically to FIG. 3B, the center of annulus 30, which in part forms detector 24, resides a distance $d_1$ from lens 20 along axis 26, and the center of annulus 28, which in part forms detector 22, resides at a distance $d_2$ from lens 20 along axis 26.

The center of detector 24 resides closer to lens 20 than the center of detector 22. The focal surface upon which light emerging from lens 20 focuses does not represent a plane. Rather, this focal surface roughly conforms to the shape of spherical surface 36. Thus, the difference between distances $d_1$ and $d_2$ tends to neutralize the curvature of the focal surface. In other words, lens 20 causes light from conical beam 12 to focus at distance $d_2$ from lens 20 while lens 20 causes light from conical beam 14 to focus at a distance $d_1$ from lens 20. Accordingly, detectors 22 and 24 are placed at optimum positions to receive focused light.

Referring specifically to FIG. 3A, spherical surface 36 of lens 20 represents a portion of the sphere shown collectively by the solid and dashed lines. FIG. 3A illustrates a hemisphere in which flat surface 38 of lens 20 resides coplanar with the flat surface of the hemisphere, and the center of curvature of the hemisphere represents the intersection of axis 26 and flat surface 38. Each point on spherical surface 36 resides substantially equidistant from the center of curvature.

An extra lens portion 46 and an extra lens portion 44 do not form a part of lens 20, but together with lens 20 form a hemisphere. Lens 20 together with extra lens portion 44 form a cylindrical core sample of this hemisphere which is centered about lens axis 26.

The removal of portion 44 from this cylindrical core sample allows the installation of axis 26 of lens 20 as near as possible to skin 48 and window 50. As a result, window 50 may exhibit a smaller window size than would be required if axis 26 of lens 20 resided further away from skin 48. Furthermore, the removal of portion 44 from this cylindrical core coupled with the placement of lens 20 adjacent to skin 48 permits inner conical beam 12 to exhibit smaller half conic angles relative to axis 26 for a given size of window 50. Resultingly, this structural combination allows a further forward looking conical beam from missile 10 (see FIG. 1) given a specific strength of missile skin 48.

The sides of lens 20 are defined by a non-planar side-surface 40. Due to the removal of extra-lens portion 44 from the cylindrical core sample, one portion of non-planar side surface 40 resides closer to lens axis 26 than other portions of side-surface 40.

The preferred embodiment of the present invention constructs lens 20 from germanium. Germanium represents a desirable material because it exhibits a relatively large index of refraction. A large index of refraction permits conical beams 12 and 14 to "bend" more than they would with substances having smaller indexes of refraction. A larger range of half conic angles for conical beams 12 and 14 results. Furthermore, smaller, less expensive, and less noisy detectors 22 and 24 may be constructed because of this relatively large index of refraction. Additionally, germanium transmits a wide range of infrared wave lengths with substantially equivalent index of refractions for each of the wave lengths. Thus, the use of germanium in lens 20 reduces chromatic aberrations.

Flat surface 38 represents only a generally flat surface. Specifically, flat surface 38 contains an aspheric correcting surface or a non-planar face 42 which tends to correct aberrations caused by spherical surface 36. Additionally, optical coma and astigmatism are eliminated since the center of curvature of spherical surface 36 is at the aperture stop of lens 20.

Barrel and pin cushion optical distortion is compensated for by selecting proper radiuses for detectors 22 and 24. These proper radiuses may be determined empirically. However, the wide-angle lens described above for lens 20 tends to provide barrel distortion, which is desirable in the present invention because it tends to reduce the radiuses of detectors 22 and 24 over radiuses which would be required if lens 20 exhibited no distortion. The reduced radiuses of dectectors 22 and 24 causes detectors 22 and 24 to require less material. The cost associated with detectors 22 and 24 and the noise level of electrical signals output from detectors 22 and 24 decreases accordingly.

Figure 4A:
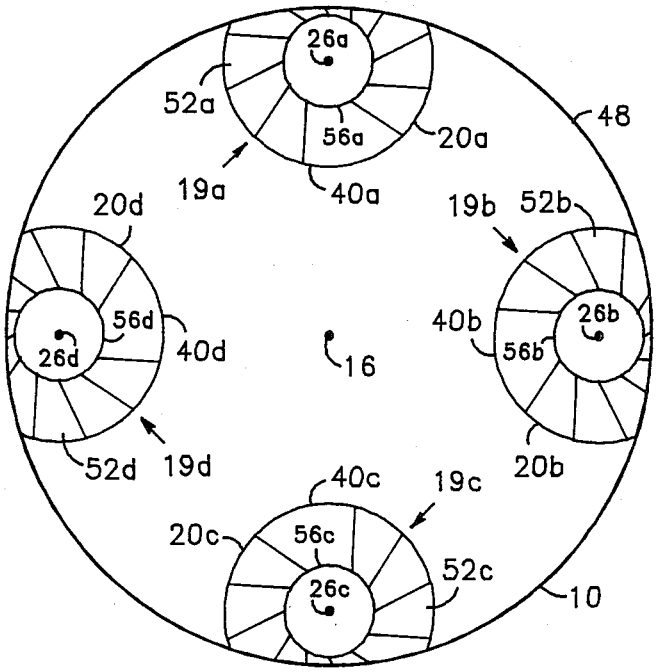
FIG. 4A shows a cross section of a missile which utilizes the present invention.
Figure 4B:
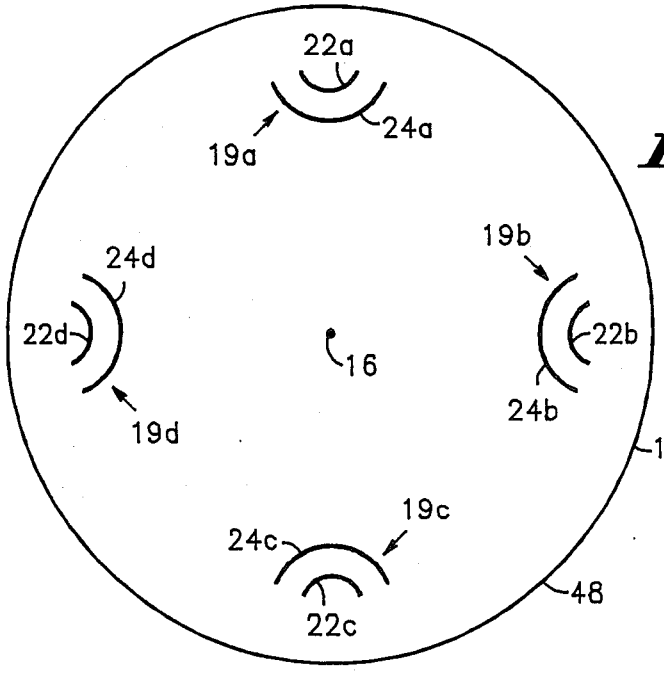
FIG. 4B shows a cross section of a missile which utilizes the present invention.

FIGS. 4A and 4B each show a cross-sectional view of missile 10 taken perpendicular to the cross-sectional view shown in FIGS. 3A and 3B. The cross sections of FIGS. 4A and 4B are taken at lines 4A and 4B, respectively, shown in FIG. 3B. Referring simultaneously to FIGS. 4A and 4B, a missile is shown as including four optical assemblies 19*a*, 19*b*, 19*c* and 19*d*. FIG. 4A shows the lens 20 portion of optical assemblies 19, and FIG. 4B shows detectors 22 and 24 of optical assemblies 19.

Specifically, in FIGS. 4A and 4B, missile axis 16 resides in the center of missile 10 and is surrounded by a substantially circular missile skin 48. Referring to FIG. 4A, lenses 20*a*, 20*b*, 20*c* and 20*d* reside in clockwise order at 90° intervals around the interior portion of skin 48. Lenses 2*a*–20*d* have opaque members 52*a*, 52*b*, 52*c* and 52*d* along with entrance apertures 56*a*, 56*b*, 56*c* and 56*d*, respectively, associated therewith. As discussed above in connection with FIGS. 3, axes 26*a*, 26*b*, 26*c* and 26*d*, associated with lenses 20*a* through 20*d*, respectively, reside closer to one portion of side-surfaces surfaces 40*a*, 40*b*, 40*c* and 40*d* of lenses 20*a* through 20*d*, respectively, than to other portions of side-surfaces 40.

Referring to FIG. 4B, inner detector 22*a* and outer detector 24*a*, inner detector 22*b* and outer detector 24*b*, inner detector 22*c* and outer detector 24*c*, and inner detector 22*d* and outer detector 24*d* reside in clockwise order at 90° intervals around the interior of skin 48. Each of detectors a, b, c and d in FIG. 4B occupy a unique and different 90° quadrant of an annulus from that occupied by the other ones of detectors a through d. As a result, each of optical assemblies 19*a* through 19*c* sense a unique 90° portion of conical beams 12 and 14 (see FIG. 2). Each of optical assemblies 19 has its own lens 20 which is substantially identical to other lenses 20. Each of lenses 20 has its own lens axis 26. Each of lens axes 26 resides parallel to missile axis 16. Additionally, each of lens axes 26 is noncoincident with missile axes 16. Therefore, the portions of conical beams 12 and 14 sensed by each of optical assemblies 19*a* through 19*d* actually center upon different axes. However, the aggregate axis for the four unique 90° conic sections is represented by missile axis 16. Except for distances which are very close to missile 10, the difference in axes has only an insubstantial effect in the collective electrical signals provided by detectors 22 and 24.

In summary, the preferred embodiment of the present invention provides a symmetrical and uniform response with azimuth due to the parallel orientation of axes 26 of lenses 20 relative to axis 16 of missile 10. Additionally, the present invention utilizes only a single lens element 20 in an optical assembly 19 and is therefore a relatively simple, reliable and inexpensive optical sensor. Optical assemblies 19 each look out a small side window in missile 10. The use of small side windows increases the strength of missile 10 over that achievable with optical detectors which require a lens that completely surrounds a missile. Still further, the present invention, through the use of multiple detectors, permits the sensing of targets within multiple conical beams, and the present invention represents an imaging system which provides azimuth information related to a sensed target.

The present invention has been described above with reference to a particular embodiment to facilitate teaching the invention. Those skilled in the art will recognize that many alternative embodiments also fall within the scope of the present invention. For example, the present invention might utilize a single lens located in a nose cone section of a missile. Then, fully populated annular detectors could be used so that a single optical assembly 19 views an entire 360° of azimuth. In this alternative embodiment, extra lens portion 44 (see FIG. 3*a*) would not be removed from a cylindrical core as described above. Additionally, the present invention could operate in connection with an active optical system which illuminates a volume of space forward of missile 10 and then senses reflections from targets within that volume. These and other changes and modifications to the above-described preferred embodiment which are obvious to those skilled in the art are intended to be included within the scope of the present invention.

I claim:

1. A conical beam target sensor for use on a missile having a skin surrounding the periphery of the missile, having a missile axis, and having a transparent window in the skin of the missile facing substantially perpendicular to the missile axis, the target sensor comprising:

a wide-angle lens having an axis associated therewith, said lens residing so that the axis of said lens is noncoincident with and parallel to the missile axis; and a detector forming at least a portion of an annulus which is centered on the axis of said lens.

2. A conical beam target sensor as claimed in claim 1 wherein said detector comprises a plurality of photoelectric elements.

3. A conical beam target sensor as claimed in claim 1 wherein the annulus of said detector exhibits a first predetermined radius and the target sensor additionally comprises a second detector forming at least a portion of a second annulus which is centered on the axis of said lens and exhibits a second predetermined radius which is greater than said first predetermined radius.

4. A conical beam target sensor as claimed in claim 3 wherein the annulus of said first detector has a center and the annulus of said second detector has a center, and the annulus center of said second detector resides closer to said lens than the annulus center of said first detector.

5. A conical beam target sensor as claimed in claim 1 wherein said lens is constructed from germanium.

6. A conical beam target sensor as claimed in claim 1 wherein said lens resides within the missile proximate the missile window and substantially adjacent to the missile skin.

7. A conical beam target sensor as claimed in claim 6 wherein the missile has second and third transparent windows in the skin of the missile, said second and third windows each facing substantially perpendicular to the missile axis, and the target sensor additionally comprises:

a second wide-angle lens located within the missile proximate the missile second window and substantially adjacent to the missile skin, said second lens having an axis associated therewith, and said second lens residing so that the axis of said second lens is non-coincident with and parallel to the axis of the missile;

a second detector forming at least a portion of an annulus which is centered on the axis of said second lens;

a third wide-angle lens located within the missile proximate the missile third window and substantially adjacent to the missile skin, said third lens having an axis associated therewith, and said third lens residing so that the axis of said third lens is non-coincident with and parallel to the axis of the missile; and a third detector forming at least a portion of an annulus which is centered on the axis of said third lens.

8. A conical beam target sensor as claimed in claim 1 wherein said wide-angle lens is formed to have a spherical surface opposing a substantially flat surface, said lens spherical surface having a center of curvature located substantially at the intersection of said lens flat surface and said lens axis, and said lens being oriented so that said lens spherical surface faces said detector.

9. A conical beam target sensor as claimed in claim 8 wherein said lens additionally comprises a non-planar side-surface, and the lens axis resides closer to a first portion of the side surface than to a second portion of the side-surface.

10. A conical beam target sensor as claimed in claim 8 wherein the substantially flat surface of said lens is a non-planar face constructed to correct for spherical aberrations.

11. A method of photoelectrically viewing a volume of space having a shape resembling at least a portion of a wall of a hollow cone, the method comprising the steps of:

orienting a wide-angle lens so that an axis of the lens is noncoincident with and parallel to an axis of the cone;

forming a detector to exhibit a shape resembling at least a portion of an annulus; and locating the detector of said forming step so that the annulus is centered on the axis of the lens and the detector resides a distance from the lens substantially equivalent to a focal length of the lens.

12. A method as claimed in claim 11 wherein said forming step utilizes a plurality of photoelectric elements in forming the detector.

13. A method as claimed in claim 11 additionally comprising the steps of:

forming a second detector to exhibit a shape resembling at least a portion of a second annulus having a radius greater than a radius of the first detector; and locating the second detector so that the second annulus is centered on the axis of the lens and the second detector resides a distance from the lens substantially equivalent to a focal length of the lens.

14. A method as claimed in claim 11 additionally comprising the step of positioning the lens in a missile having a skin surrounding the periphery of the missile, having an axis substantially coincident with the axis of the cone, and having a transparent window in the skin of the missile facing substantially perpendicular to the missile axis so that the lens resides within the missile proximate the missile window and substantially adjacent to the missile skin.

15. A method as claimed in claim 14 wherein the missile has second and third transparent windows in the skin of the missile, the second and third windows face substantially perpendicular to the missile axis, and the method additionally comprises the steps of:

orienting a second wide-angle lens so that an axis of the second lens is non-coincident with and parallel to the axis of the cone;

forming a second detector to exhibit a shape resembling at least a portion of a second annulus;

locating the second detector so that the second annulus is centered on the axis of the second lens and the second detector resides a distance from the second lens substantially equivalent to a focal length of the second lens;

orienting a third wide-angle lens so that an axis of the third lens is non-coincident with and parallel to the axis of the cone;

forming a third detector to exhibit a shape resembling at least a portion of a third annulus; and locating the third detector so that the third annulus is centered on the axis of the third lens and the third detector resides a distance from the third lens substantially equivalent to a focal length of the third lens.

16. A method as claimed in claim 11 wherein the lens has a spherical surface opposing a substantially flat surface, said lens spherical surface has a center of curvature located substantially at the intersection of the lens flat surface and the lens axis, and the method additionally comprises the step of positioning the lens so that the spherical surface of the lens faces the detector.

17. A conical beam target sensor wherein the target sensor is for use on a missile having a skin surrounding the periphery of the missile, having an axis, and having a transparent window in the skin of the missile facing substantially perpendicular to the missile axis, the target sensor comprising:

a wide-angle lens having a focal length and an axis associated therewith, said lens being locatable within the missile proximate the missile window and substantially adjacent to the missile skin so that the axis of said lens is non-coincident with and is parallel to the axis of the missile; and a plurality of photoelectric elements arranged to form at least a portion of an annulus which is centered on the axis of said lens and each of which reside a distance from said lens substantially equal to the focal length of said lens.

18. A target sensor as claimed in claim 17 wherein said wide-angle lens is formed to have a spherical surface opposing a substantially flat surface, said lens spherical surface having a center of curvature located substantially at the intersection of said lens flat surface and said lens axis, and said lens being oriented so that said lens spherical surface faces said plurality of photoelectric elements, said lens additionally being formed to have a non-planar side-surface so that the lens axis resides closer to a first portion of the side-surface than a second portion of the side-surface.

* * * * *